United States Patent [19]

Dietrich et al.

[11] Patent Number: 4,502,356

[45] Date of Patent: Mar. 5, 1985

[54] PARTING SWORD ON EQUIPMENT FOR LETTING OUT HIDES

[75] Inventors: Herbert Dietrich; Günther Mall, both of Kaiserslautern, Fed. Rep. of Germany

[73] Assignee: Pfaff Industriemaschinen GmbH, Fed. Rep. of Germany

[21] Appl. No.: 362,108

[22] Filed: Mar. 26, 1982

[30] Foreign Application Priority Data

Apr. 6, 1981 [DE] Fed. Rep. of Germany ..... 3113835

[51] Int. Cl.[3] ..... B26D 7/02; C14B 1/20

[52] U.S. Cl. ..... 83/175; 69/15; 69/16; 69/34; 83/176

[58] Field of Search ..... 69/1, 2, 7.7, 9.3, 9.5, 69/40; 83/17, 18, 19, 20, 21, 175, 176, 915

[56] References Cited

U.S. PATENT DOCUMENTS 60,531 12/1866 Manning ..... 69/1

3,934,776 1/1976 Cruden, Jr. ..... 83/176 X

FOREIGN PATENT DOCUMENTS 2204399 8/1973 Fed. Rep. of Germany .

507304 6/1939 United Kingdom ..... 83/176

*Primary Examiner*—Wm. Carter Reynolds

*Attorney, Agent, or Firm*—McGlew and Tuttle

[57] ABSTRACT

A device is disclosed for letting out hides which comprises a table having a longitudinally extending slot therein for supporting a hide, clamping jaws movable laterally of the slot to clamp a fold in the hide, and a parting sword raisable into the slot to form a fold in the hide and move it into the space between the jaws. One of the jaws is movable parallel to the longitudinal slot to offset part of the hide after it is cut. The parting sword is made up of a pair of side plates and an intermediate plate. One side plate which is adjacent the lengthwise movable jaw is also movable to facilitate the movement of the hide part therebetween into its offset position and the intermediate plate is movable vertically with respect to the side plates so as to form a slot between the side plates in a lowered position to facilitate cutting of the hide and, to permit the clamping of the hide parts using the clamping jaws, against the intermediate plate, with the intermediate plate raised above the side plates.

6 Claims, 9 Drawing Figures

PARTING SWORD ON EQUIPMENT FOR LETTING OUT HIDES

FIELD AND BACKGROUND OF THE INVENTION

The present invention relates in general to equipment for the processing of animal and artificial hides having hair on one side thereof, and in particular to a new and useful device for letting out a hide so that it can be cut at various locations with the parts offset from each other and sewn back together.

German Pat. No. 22 04 399 discloses equipment for letting out hides which comprises two serrated clamping jaws above a table panel for receiving the hide which are movable relative to each other in a longitudinal and transverse direction, between which a parting sword that is displaceable in a longitudinal direction and movable up and down and which has a longitudinal groove and a hide divider, is arranged. Above the parting sword, a lowerable cutting device is arranged, and laterally of the parting sword, a sewing machine is provided.

For the letting out of a hide, where the hide is divided into two parts several times in succession and the respective hide parts are offset to each other and then sewn together again, the hide hairs are parted to form a furrow in the region of the cutting line by means of the hide divider and the parting sword. As soon as the parting sword lies completely in the parting furrow, it is raised, whereby a fold lying between the clamping jaws is formed. Then, by moving the jaws toward each other, the hide is clamped and fixed on the parting sword and is subsequently divided by the cutting device, the knife engaging in a longitudinal groove of the parting sword. After the hide has been cut, the so-called backspacing is carried out, in that, with the parting sword still raised, one of the clamping jaws is shifted relative to the other in the lengthwise direction and thereby one of the hide parts, which is pressed by the jaw against the parting sword, is laterally offset relative to the other hide part. The parting sword thereby exerts a braking action on the hide part which is to be offset laterally. Although the clamping areas of the clamping jaws are serrated, it can happen nevertheless that due to the braking action of the parting sword the clamping jaw which does the backspacing does not take the hide part along completely or pulls it askew.

SUMMARY OF THE INVENTION

It is the object of the present invention to provide equipment which makes it possible in an operation for backspacing the hide part to be offset laterally, that the hide part is shifted sideways exactly to the same adjustable length in a manner that is repeatable any desired number of times.

According to the invention the parting sword is divided into several parts that are parallel to its lengthwise direction, with a first part that is movable jointly with the clamping jaw and correlated with it in the longitudinal direction relative to a second part of the sword. The hide part to be offset laterally is thus held in plier fashion during backspacing between the backspacing jaw and the part of the parting sword correlated with it. In this way a lagging or pulling askew of the hide part is ruled out even if the backspacing lengths are great.

After the backspacing, the parting sword is lowered and thereby removed from the region of the cut edges of the two hide parts, whereupon the now contiguous cut edges are sewn together again. Due to the fact that the cutting sword is provided with a longitudinal groove for the knife blade for sure cutting of the hide, the sword has a relatively wide cross-section. The result is that the cut edges of the two hide parts are, at the time that the sword dips under the serrated clamping area of the two jaws, bent relatively strongly for a short time, until they are pressed against one another by the clamping jaws moving up. Due to the strong bending, the hide parts may become detached from the serration of the jaws, whereupon the cut edges are pulled along downwardly by the parting sword at least in part. In that case the two hide parts can no longer be properly sewn together.

It is therefore a further object of the invention to design the equipment so that the cut edges of the hide parts are secured against moving along during the lowering of the parting sword.

This is done by arranging, between the two parts of the parting sword, a third part which is movable in the vertical direction relative to the other parts, and which can advantageously be realized by arranging between two sideplates an interplate movable relative thereto. After the cutting of the hide and before the lowering of the parting sword, the interplate is raised over the top of the two sideplates, whereby the parting sword is offset upwardly in steps. As the parting sword is lowered, the cut edges of the two hide parts are then moved toward each other stepwise, in that, as the sideplates dip below the clamping jaws, they are pressed first against the interplate, and only after the interplate too, has dipped below the clamping jaws, they are pressed directly against each other. On the assumption that the cross-sectional width of the parting sword, consisting of the sideplates and the interplate, corresponds to the cross-sectional width of a one-piece parting sword, the cut edges of the two hide parts are bent only slightly during the lowering of the stepped parting sword. There is no danger, therefore, that the cut edges will become detached from the serration of the clamping jaws and will be pulled along downwardly by the parting sword.

Before cutting the hide, the interplate is pulled back below the top of the sideplates, whereby a longitudinal groove for the knife blade is formed between the sideplates.

These last mentioned features by themselves, constitute an advantageous design of the parting sword, since even without the first mentioned features, a moving along of the cut edges of the hide parts during lowering of the parting sword is prevented.

Accordingly an object of the present invention is to provide a device for letting out a hide comprising, a table for supporting the hide having a longitudinally extending slot therein, a pair of clamping jaws movable above the table and on either side of the slot, first drive means connected to the jaws for moving them transversely to the longitudinal slot and together to clamp a fold of hide therebetween, second drive means connected to one of the jaws for moving that jaw parallel to the longitudinal slot, cutting means for cutting the fold of hide, a parting sword movable into the slot for raising the hide to form the fold and move it into the space between the jaws, third drive means connected to the sword for raising the sword, the sword made up of a pair of sideplates and an intermediate plate, one of the side plates being movable in conjunction with the one jaw to clamp a piece of the hide after it is cut and permit its movement in the longitudinal direction of the slot, the intermediate plate being lowerable to expose a slot between the side plates to facilitate cutting of the hide fold, and raised above a top edge of the side plates to permit a stepwise lowering of the side plates and thereafter of the intermediate plate while the clamping jaws are moved by the first drive means inwardly to hold the hide parts.

A further object of the invention is to provide such a device for letting out hides which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings, and descriptive matter in which a preferred embodiment of the invention is illustrated.

BRIEF DESCRIPTION OF THE DRAWINGS

The invention is explained with reference to an embodiment illustrated in the drawings, in which.

DETAILED DESCRIPTION OF THE PREFERRED EMBODIMENT

Figure 1:
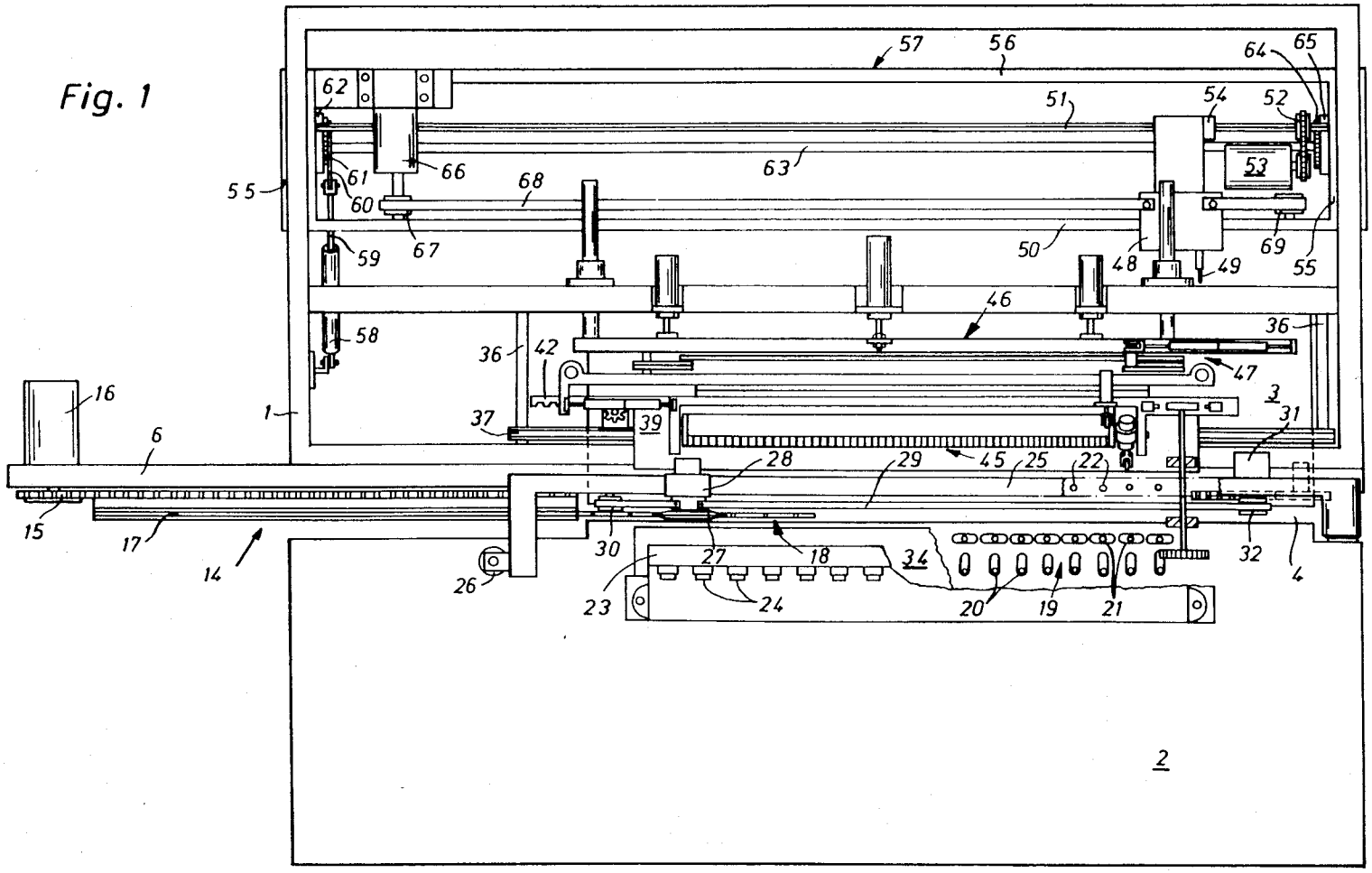
FIG. 1 is a top view of hide letting-out equipment according to the invention.

Referring to the drawings in particular, the invention embodied therein comprises a device for letting out hide which is to be cut into two parts, with one part to be offset from the other. The parts are intended to be sewn back together to let out the hide.

A front horizontal table panel 2 (FIG. 1) and a rear table panel 3 are arranged on a frame 1, the panel 3 being in part inclined downwardly. The two table panels 2, 3 are separated by a slit 4. A horizontal beam 6 which extends parallel to slit 4, is arranged for vertical displacement on two vertical guide rods 5 (FIG. 2). Beam 6 is supported on piston rods 7 of two compressed air cylinders 8. The housing 9 of each cylinder 8 is fastened on the housing 10 of an additional serially connected compressed air cylinder 11, the piston rod 12 of which takes support on a shoulder 13 secured to frame 1. By means of the two pairs of serially connected compressed air cylinders 8, 11, the beam 6 can be moved to three different vertical level positions.

On beam 6 a parting sword 14 is arranged, which is displaceable lengthwise relative to beam 6 and is in drive connection via a chain 15 with a brake motor 16 secured to beam 6. At its top the parting sword 14 is provided with a longitudinal groove 17 and at its front end it carries a comb-like hide divider 18 extending parallel thereto.

On both sides of slit 4, a holding device 19 (FIG. 1) for the hides which are placed on the table panels 2, 3 is provided, which device consists of two needle rows under the front table panel 2 and an additional needle row under the rear panel 3. The needle rows 20, 21, 22 can be moved up and down and protrude in the raised position through corresponding openings not marked in the table panels 2, 3, beyond the tops thereof.

Figures 2, 3:
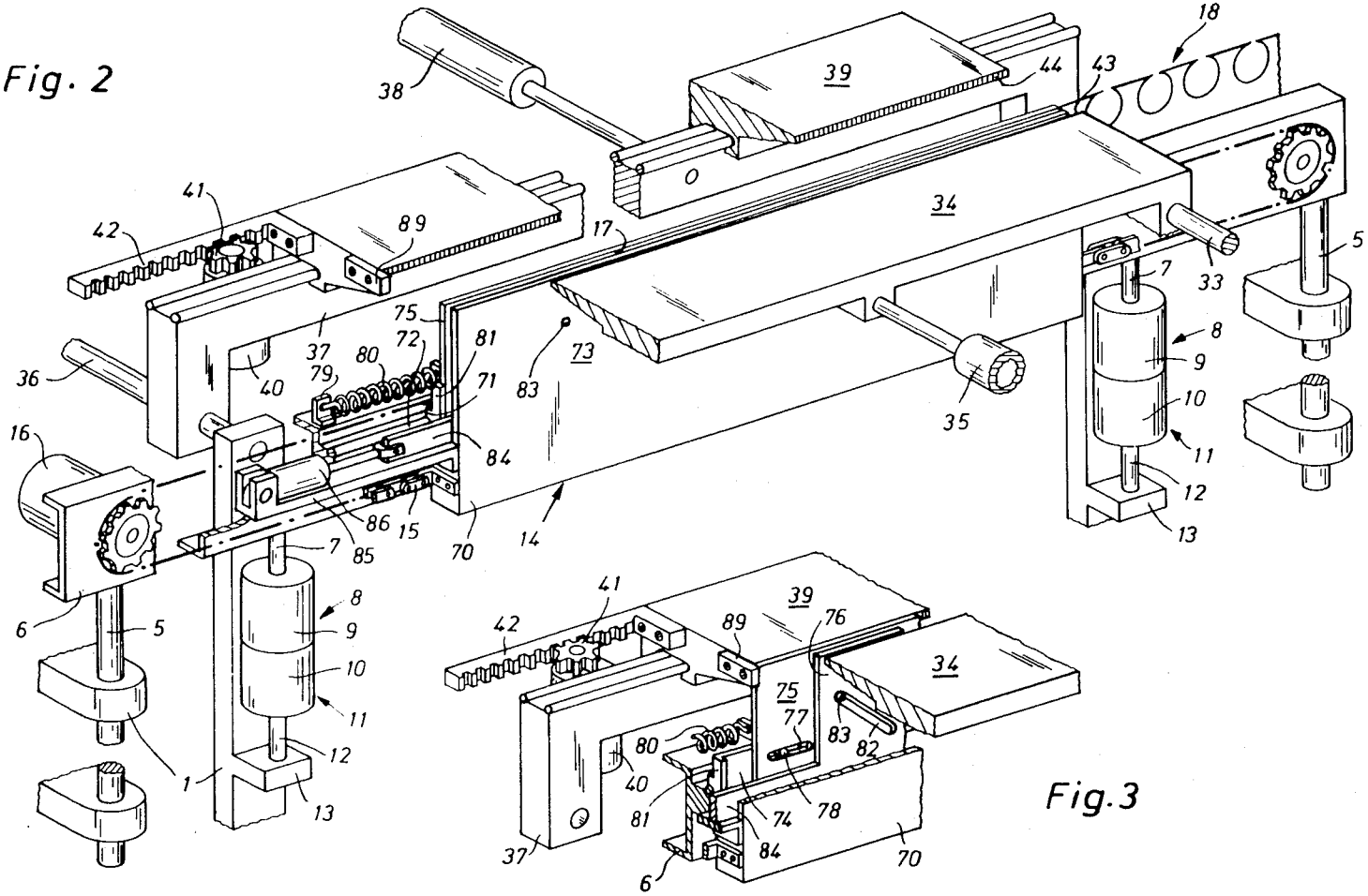
FIG. 2 is a diagrammatic representation of the parting sword and of the clamping jaws before the backspacing operation.
FIG. 3 is a diagrammatic representation of a part of the parting sword and of the clamping jaws during a backspacing operation.

The parting sword 14 has associated with it an elongated hold-down 23 (FIG. 1) extending parallel to it, which by means (not shown) can be moved from the position shown in FIG. 1, which is set back crosswise and raised, toward the parting sword 14 and can at the same time be lowered. At the hold-down 23 several compressed air connections 24 are arranged, which are connected with a plurality of downwardly directed compressed air nozzles (not shown).

A guide rod 25 (FIG. 1) is pivotably mounted on frame 1, which can be swung up and down by means of a compressed air cylinder 26 disposed on frame 1 in a manner not explained in detail. On the guide rod 25, a cutting device 28 equipped with a circular knife 27, is slidably mounted. The cutting edge of knife 27 lies within a vertical plane passing through the longitudinal groove 17 of the parting sword 14. The cutting device 28 is firmly connected with a toothed belt 29 which runs over a guide wheel 30 mounted on the guide rod 25 and over a drive wheel 32 likewise mounted on the guide rod 25 and connected with a motor 31.

A horizontal front clamping jaw 34 is mounted on fixed slide rods 33 above the front table panel 2 (FIG. 2). Jaw 34 can be moved forwardly and backwardly by a compressed air cylinder 35 crosswise to the longitudinal axis of the parting sword 14. Above the rear table panel 3, a horizontal beam 37 which is mounted on fixed slide rods 36 is arranged, which beam can be moved forwardly and backwardly by a compressed air cylinder 38 crosswise to the longitudinal axis of the parting sword 14. A rear clamping jaw 39 which is movable parallel to the parting sword 14 is arranged on beam 37. A step motor 40 is also secured to beam 37, which drives a pinion 41. Pinion 41 meshes with a rack 42 secured to the rear clamping jaw 39. The jaws 34, 39 are cuneiform or wedge-shaped on the sides facing each other and form serrated narrow clamping areas 43, 44.

A feed device 46 (FIG. 1) provided with a gripping tool 45 serves to advance the hides. The drive mechanism of the gripping tool 45 is marked 47.

The sewing machine 48 (FIG. 1) for sewing the hide parts together has a needle 49 movable back and forth in a horizontal plane. The sewing machine 48 is displaceably mounted on a guide rod 50 extending in a horizontal plane parallel to the parting sword 14 and on a serrated shaft 51 parallel to rod 50. The serrated shaft 51 is connected via a chain drive 52 with a brake motor 53 and drives the mechanism (not shown) of the sewing machine 48 via a cam wheel 54 provided with internal serrations. The guide rod 50 and serrated shaft 51 are arranged in two slides 55, which are mounted on frame 1 and are movable crosswise to the parting sword 14. The slides 55 are connected together by a fixed rod 56 and form a frame 57. A compressed air cylinder 58, whose piston rod 59 drives, via a lever 60, a gear 61, serves to move frame 57. Gear 61 is connected via a torsion-rigid shaft 63 with an additional gear 64, which meshes with a second rack 65 also fastened to frame 57. A step motor 66 is secured on frame 57, which via drive wheel 67, drives a toothed belt 68. Belt 68 runs over a guide wheel 69 mounted on frame 57 and is firmly connected with the sewing machine 48.

Figure 5:
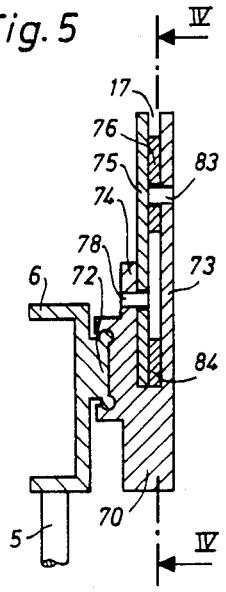
FIG. 5 is a sectional representation of the parting sword taken along the line V—V in FIG. 4.
Figure 6:
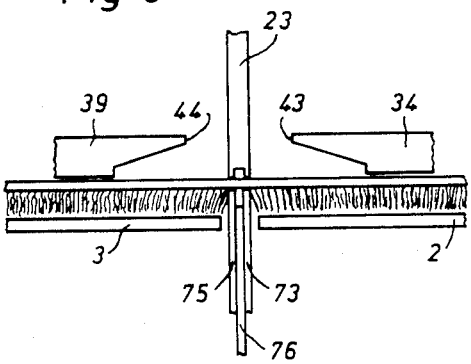
FIGS. 6 to 9 are sectional partial representations of successive operational phases of the equipment.

The parting sword 14 has a slide 70 which is arranged by two projections 71 on a truck 72 secured to beam 6. On the side of slide 70 toward the front clamping jaw 34, a front sideplate 73, and spaced therefrom, a low shoulder 74, are formed (FIG. 5). Between the front sideplate 73 and the shoulder 74, a rear sideplate 75 and an interplate 76 are arranged, both movable relative to slide 70.

Figure 4:
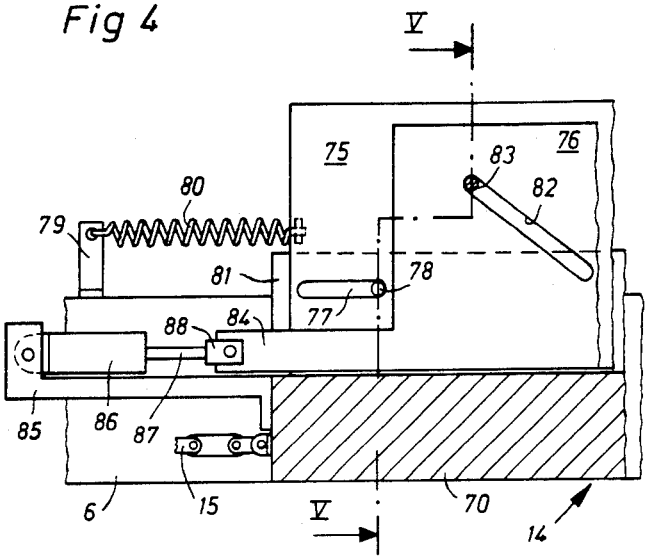
FIG. 4 is a sectional representation of the parting sword taken along the line IV—IV in FIG. 5.

The rear sideplate 75 contains two horizontal oblong slots 77, in each of which is engaged a pin 78 which is fastened in shoulder 74. On an angle piece 79 (FIG. 4) secured on beam 6, one end of an extension spring 80 is arranged, the other end of which engages the rear sideplate 75, pulling it against a shoulder 81 of slide 70 which serves as an abutment. The interplate 76 contains two codirectional slots 82 extending obliquely, in each of which is engaged a pin 83 fastened in the front sideplate 73. The height of the interplate 76 is made such that in the lowest position the plate stands below the top edges of the sideplates 73, 75 and in this manner forms the longitudinal groove 17 of the parting sword 14. On an end face of the interplate 76, an oblong projection 84 is formed. A bracket 85 is fastened on the corresponding end face of slide 70 on which a compressed air cylinder 86 is pivotably mounted. The piston rod 87 of cylinder 86 is connected to the projection 84 through a forked head 88.

A strike piece 89 (FIG. 3) is fastened on an end face of the rear clamping jaw 39 which projects beyond the clamping area by the thickness of the rear sideplate 75 crosswise to the lengthwise direction thereof.

The equipment operates as follows:

A hide to be let out is placed, hairy side down, on the table panels 2 and 3. Then the needle rows 20, 22 are moved upwardly, whereby the hide is fixed on the table panels 2, 3. Thereafter the hold-down 23 is lowered onto the hide, and the parting sword 14 with a hide hair divider 18 is moved by the brake motor 16 out of the inoperative position shown in FIG. 1 in the direction of the hide, far enough for the front section of the hide divider 18 to be under the hide.

Then the two compressed air cylinders 8 are pressurized, whereby beam 6 with the parting sword 14 and with the hide divider 18 is raised. At the end of this lifting movement, the hide divider 18 applies against the hide. By repeated brief forward and reverse rotation of the brake motor 16, the hide divider 18 is moved reciprocally in the lengthwise direction, whereby it forms a parting furrow in the hide hair. Thereafter the parting sword 14 is pushed by the brake motor 16 into the parting furrow drawn by the hide divider 18.

Figure 7:
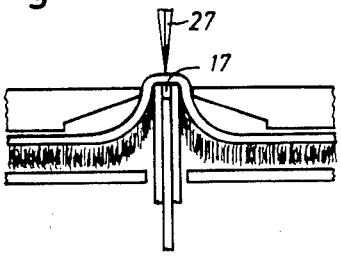

As soon as the parting sword 14 is in the parting furrow, the two compressed air cylinders 11 are pressurized, whereby beam 6 is raised still more. In so doing, the parting sword 14 lifts the hide to the height of the clamping areas 43, 44 of the clamping jaws 34, 39, with formation of a fold in the hide (FIG. 7). The parting sword 14 is now in the operative position for backspacing. After the lifting of the parting sword 14, the two jaws 34, 39 are moved toward each other by the air cylinders 35, 38. The jaws 34, 39 press the hide against the front sideplate 73 and against the rear sideplate 75. The strike piece 89 fastened on the rear jaw 39, has then moved behind the front face of the rear sideplate 75. The hide having been clamped between the jaws 34, 39 and the parting sword 14, the guide rod 25 is lowered and the hide is divided by the cutting device 28, the cutting edge of knife 27 engaging in the longitudinal groove 17.

After the raising of the guide rod 25 with the cutting device 28, backspacing is carried out, in that the rear clamping jaw 39 is displaced by the step motor 40 by a given amount in the lengthwise direction of the parting sword 14. By the strike piece 89, which is fastened on the rear jaw 39 and applies against the end face of plate 75, the rear jaw 39 pulls the rear sideplate 75 along in lengthwise direction counter to the action of the extension spring 80, while the front sideplate 73 and the front jaw 34 remain in place. Since in this case the two hide parts are held in plier fashion, the hide part to be moved cannot stick during backspacing or be pulled askew, and the other hide part, whose position is to remain unchanged, cannot be pulled along.

Figure 8:
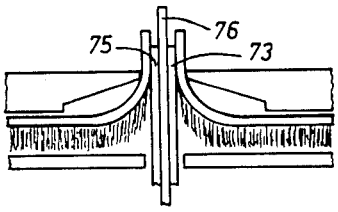

After the backspacing operation, by pressurization of the air cylinder 86 the interplate 76 is moved obliquely upwardly until it partially projects beyond the sideplates 73, 75 (FIG. 8). With plate 76 raised, the parting sword 14 has a stepped cross-sectional profile.

Figure 9:
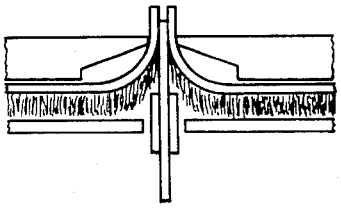

Then, by simultaneous pressurization of the air cylinders 8 and 11, beam 6 with the parting sword 14 is lowered to its lowest position. The cut edges of the hide parts are thereby bent in the direction of interplate 76 at the time when the upper edges of the sideplates 73, 75 dip below the toothed clamping areas 43, 44 of the two jaws 34, 39 and are pressed against the interplate 76 by the moving up of the jaws 34, 39 (FIG. 9). In the further course of the lowering process, also the upper edge of the interplate 76 dips below the clamping areas 43, 44, whereupon the jaws 34, 39 press the cut edges of the hide parts directly against each other. During the lowering of the parting sword 14, therefore, the cut edges of the hide parts are moved toward each other in stepwise fashion, being bent only slightly due to the small thickness of the sideplates 73, 75 and of the interplate 76. There is thus no danger that the hide parts will become detached from the serration of the clamping jaws 34, 39 and be pulled along downwardly by the parting sword 14.

The height of the strike piece 89 is dimensioned so that the rear sideplate 75 dips below the strike piece 89 during the lowering of the parting sword 14 and is then pulled back against the shoulder 81 by the extension spring 80 only after both sideplates 73, 75 are sufficiently far removed from the hide parts. Hence there is no danger that the rear sideplate 75, returning to the starting position and in so doing moving relative to the rear clamping jaw 39, will inadvertently pull along the respective hide part.

As soon as the parting sword 14 has been completely lowered and thereby the interplate 76 removed from the region of the cut edges of the hide parts, the latter are sewn together again by the sewing machine 48.

While a specific embodiment of the invention has been shown and described in detail to illustrate the application of the principles of the invention, it will be understood that the invention may be embodied otherwise without departing from such principles.

What is claimed is:

1. A device for letting out a hide comprising:

a pair of movable clamping jaws defining a longitudinal space therebetween;

a parting sword movable to raise a hide and form a fold to be moved into the longitudinal space between the clamping jaws;

cutting means for cutting the fold in the hide to cut the hide into two parts;

first drive means connected to the jaws for moving them together transverse to the longitudinal space to clamp the hide fold to be cut;

second drive means connected to one of the jaws for moving the one jaw parallel to the longitudinal space;

third drive means connected to the parting sword for raising the parting sword into the space; and fourth drive means connected to the parting sword for moving the parting sword parallel to the longitudinal space;

the parting sword comprising a pair of spaced side plates and an intermediate plate extending longitudinally with the space; means connected to one of the side plates and the one jaw and positioned therebetween for moving the one side plate with the one jaw in a direction parallel to the space for holding a hide part between the one jaw and the one side plate, and fifth drive means connected to the intermediate plate for raising and lowering the intermediate plate with respect to the side plates for permitting stepwise lowering of the side plates and intermediate plate sequentially with corresponding transverse movement of the clamping jaws to move hide parts together, the fifth drive means operable to move the intermediate plate downwardly of the side plates to form a groove therebetween for the cutting means.

2. A device according to claim 1, including a table for supporting the hide having a longitudinally extending slot therein, extending parallel to the longitudinal space between the clamping jaws, and holding means for holding the hide on the table, the first drive means being connected to the jaws for moving the jaws together transversely to the longitudinal slot, the second drive means being connected to the one jaw for moving the one jaw parallel to the longitudinal slot and the third drive means being connected to the parting sword for raising the parting sword into the longitudinal slot.

3. A device according to claim 2, wherein the means between the one side plate and the one jaw comprise a stop connected to the one jaw and a spring connected to the one side plate so that movement of the one side jaw by the second drive means causes movement of the one side plate.

4. A device according to claim 2, wherein the parting sword includes a beam mounted for vertical movement, a slide slidably mounted to the beam for movement in the direction of the longitudinal slot, the intermediate plate having at least one obliquely extending slot therein, a pin connected to the slide and extending into the slot, the fifth drive means comprising a driver connected between the slide and the intermediate plate for moving the intermediate plate in a direction of the longitudinal slot which, through the action of the oblique slot, causes vertical movement of the intermediate plate.

5. Equipment for the letting out of hides, including a holding device for holding a hide, two clamping jaws cooperating in plier fashion and movable relative to each other in a lengthwise direction, a parting sword between the jaws which is displaceable in a lengthwise direction, movable upwardly and downwardly and having a longitudinal groove and at a front end thereof a hide divider, as well as a cutting device which is movable in the lengthwise direction of the parting sword, characterized in that the parting sword is divided parallel to its longitudinal direction into plural parts, a first part being movable jointly with one of the clamping jaws associated with it in the longitudinal direction relative to a second part of the sword.

6. Equipment according to claim 5, characterized in that between the first and second sword parts a third part is arranged which is movable relative to them in a vertical direction.

* * * * *